US008382344B2

(12) United States Patent
Brondt et al.

(10) Patent No.: US 8,382,344 B2
(45) Date of Patent: Feb. 26, 2013

(54) REMOTE BALLAST ASSEMBLY

(75) Inventors: Gary W. Brondt, Cheney, WA (US); Raymond A. Brown, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 626 days.

(21) Appl. No.: 12/606,373

(22) Filed: Oct. 27, 2009

(65) Prior Publication Data

US 2011/0096525 A1 Apr. 28, 2011

(51) Int. Cl.
*F21S 8/06* (2006.01)

(52) U.S. Cl. ..... 362/404; 362/147; 362/148; 362/362; 362/364

(58) Field of Classification Search ..... 362/147, 362/148, 362, 364, 404
See application file for complete search history.

(56) References Cited

U.S. PATENT DOCUMENTS 5,174,642 A * 12/1992 Brohard et al. ..... 362/20
5,546,292 A * 8/1996 Shemitz ..... 362/234
6,339,296 B1 1/2002 Goral
6,828,733 B1 12/2004 Crenshaw
6,979,097 B2 12/2005 Elam et al.
7,357,541 B2 4/2008 Gamache et al.
2006/0120073 A1 6/2006 Pickard et al.
2006/0133079 A1 6/2006 Callahan
2007/0165413 A1 7/2007 Sanner et al.
2008/0278957 A1 11/2008 Pickard et al.

OTHER PUBLICATIONS

The Bodine Company, Inc. Product Brochure, Apr. 1999.
IOTA Engineering Product Brochure, date unknown.
IOTA Engineering Accessories, available at http://www.iotaengineering.com/access_spec.htm, printed Dec. 3, 2008.

* cited by examiner

*Primary Examiner* — Meghan Dunwiddie
(74) *Attorney, Agent, or Firm* — Garrett V. Davis; Mark S. Bicks; Alfred N. Goodman

(57) ABSTRACT

A low profile lighting assembly includes a lighting fixture and a remote ballast housing mounted on a ceiling grid. The ballast housing encloses emergency ballast provides emergency power to the lighting fixture in the event of a power outage. The ballast housing can enclose a fluorescent ballast connected to one or more fluorescent lamps of the lighting fixture. The emergency ballast is recessed with respect to the top end of the ceiling grid to provide a low profile structure. Inclined side walls of the emergency ballast provide easy connection of the wiring harness and power cable to the emergency ballast while maintaining the low profile structure.

30 Claims, 4 Drawing Sheets

REMOTE BALLAST ASSEMBLY

FIELD OF THE INVENTION

The present invention is directed to a remote ballast assembly and to an emergency power system for use in recessed lighting fixtures. The assembly of the invention can include an emergency ballast and power system that can be mounted adjacent a lighting fixture to accommodate for limited space requirements above the lighting fixture.

BACKGROUND OF THE INVENTION

Fluorescent lighting fixtures can be connected to an emergency ballast and/or power system to provide emergency power in event the primary power system fails. During a power outage, the emergency power source provides sufficient power to operate the fluorescent lamps for a period of time until the power is restored. The power system typically operates the lamps at a reduced power to allow sufficient light to provide emergency lighting. The emergency power source generally includes one or more batteries that remain charged by the electrical system. The emergency ballast includes suitable circuits to recharge the batteries when the primary power source is restored.

The emergency ballast is often mounted directly to the light fixture housing on the top or the bottom. One construction is to mount the emergency ballast in the channel of the fluorescent fixture housing under the ballast cover. This generally requires a large ballast cover to enclose the emergency ballast and the ballast that is used under normal operations. The volume of the ballast, emergency power source and the required wiring often prevents the emergency ballast system from being mounted within the light fixture assembly. To accommodate for the size, the emergency ballast is often mounted on top of the light fixture housing or next to the light fixture.

One example of an emergency ballast system is disclosed in U.S. Patent Publication No. 2006/0120073 to Pickard et al. This published application discloses an emergency ballast for power fluorescent lights where the ballast has a reduced profile without the use of a bulky wiring tail. The emergency ballast includes an external header that is associated with the internal circuitry of the ballast. A connector associated with the wiring of the lighting fixture components can be inserted into or connected the emergency ballast header.

Another example of an emergency ballast is disclosed in U.S. Pat. No. 6,339,296 to Goral which discloses a low profile fluorescent lamp fixture including an AC ballast with an end of life shut down circuit. The emergency ballast includes a timing circuit which operates when AC power is restored. The timing circuit delays the application of power to the AC ballast for a given period of time during the cessation of operation of the emergency power system.

U.S. Pat. No. 6,979,097 discloses an ambient lighting system to provide light to a building. The system includes a support module, a power module, and a light fixture body. An interchangeable power module fits into the recess of the support module. The assembly can be mounted to a ceiling grid with the lighting fixture suspended below the assembly.

While the prior emergency systems have been suitable for the intended purpose, there is a continuing need in the industry for improved lighting fixtures and emergency power and ballast systems that overcome the disadvantages and limitations of the prior devices.

SUMMARY OF THE INVENTION

The present invention is directed to a low profile ballast assembly and to an emergency power system for use in recessed lighting fixtures. One aspect of the invention is directed to a housing enclosing an AC ballast and/or an emergency ballast and power system for use in suspended ceilings with limited space available above the ceiling.

Accordingly, a primary aspect of the invention is to provide a lighting fixture and a remote ballast system where the ballast system is separate from the lighting fixture and is mounted adjacent the lighting fixture in the ceiling. The remote ballast can be connected to the lighting fixture to operate the fluorescent lamps in the lighting fixture.

The ballast system of the invention is particularly suitable for use in suspended ceilings where there is no access or limited access to the light fixtures from above. The ballast system of the invention is also suitable for use in lighting fixtures mounted to a suspended ceiling where there is very limited space above the lighting fixture such that the ballast system and other electrical components cannot be mounted above the lighting fixture.

Another aspect of the invention is to provide a lighting fixture and ballast assembly mounted to a ceiling grid where the ballast assembly is mounted adjacent the lighting fixture and directly above a ceiling tile. The ballast assembly has a unitary support platform having a coupling member at each end for coupling directly to the ceiling grid. The housing of the ballast assembly has inclined side faces with openings for the power connections. The power connections are attached to adapter plates that are attached to the opening in the inclined side walls of the housing. The ballast assembly can enclose a fluorescent light AC ballast and/or an emergency ballast having an emergency power supply such as a battery pack.

Another aspect of the invention is to provide a lighting assembly connected to a ballast system where the lighting fixture and the ballast housing contain a quick connect plug mounted within the lighting fixture and the ballast housing for connecting to a wiring harness extending between the lighting fixture and the emergency ballast.

The various aspects of the invention are basically attained by providing a remote ballast and lighting assembly comprising a fluorescent lighting fixture mounted in association with a ceiling grid, a ballast housing and an electrical cable extending between the ballast housing and the lighting fixture. The ballast housing encloses an emergency ballast and has a top wall, a support platform, and first and second side walls that are inclined with respect to the support platform. At least one of the side walls has an electrical connection for the electrical cable. The electrical cable extends between the ballast housing and the top wall of the lighting fixture. The ballast housing is mounted on the ceiling grid adjacent the lighting fixture with the lighting fixture and the cable having a combined height equal to or less than the height of the ballast housing.

The aspects of the invention are also attained by providing a ballast and lighting assembly comprising a lighting fixture, a ballast housing and a wiring harness. The lighting fixture is mounted to a ceiling grid and has a housing with a top wall, an open bottom and side walls. The light fixture housing encloses a ballast and at least one lamp. The ballast housing has a support platform defining a bottom wall, a top wall and first and second side walls that are inclined with respect to the support platform. The ballast housing encloses an emergency ballast and a rechargeable power source. The support platform has a first longitudinal end with a first coupling lip and a second longitudinal end with a second coupling lip where the first and second coupling lips are coupled to the ceiling grid to mount the ballast housing adjacent the lighting fixture on the ceiling grid. The wiring harness extends between the top wall of the lighting fixture and one of the inclined side walls of the ballast housing. The lighting fixture and the wiring harness have a combined height equal to or less than the height of the ballast housing.

The various aspects of the invention are also attained by providing a ballast and lighting assembly comprising a lighting fixture mounted to a ceiling grid, a ballast housing mounted to the ceiling grid, and a wiring harness extending between the top wall of the lighting fixture and one of the side walls of the ballast housing. The lighting fixture has a housing with a top wall, an open bottom and side walls extending between the top wall and the bottom wall. The lighting housing encloses at least one lamp and a ballast. The ballast housing has a support platform defining a bottom wall, a top wall and first and second inclined side walls extending between the bottom wall and the top wall. The ballast housing encloses an emergency ballast and an emergency rechargeable power source. The support platform has a first longitudinal end with a first coupling lip and a second longitudinal end with a second coupling lip. The first and second coupling lips are coupled to the ceiling grid to mount the ballast housing adjacent the lighting fixture. The support platform lies in a plane below the top edge of the ceiling grid. The wiring harness lies in a plane at or below a plane of the top wall of the ballast housing. In one embodiment, the ballast housing encloses a fluorescent lighting ballast connected to the fluorescent light fixture.

The various aspects of the invention will become apparent from the following detailed description of the invention and the annexed drawings which disclose various embodiments of the invention.

BRIEF DESCRIPTION OF THE DRAWINGS

The following is a brief description of the drawings in which.

DETAILED DESCRIPTION OF THE INVENTION

Figure 1:
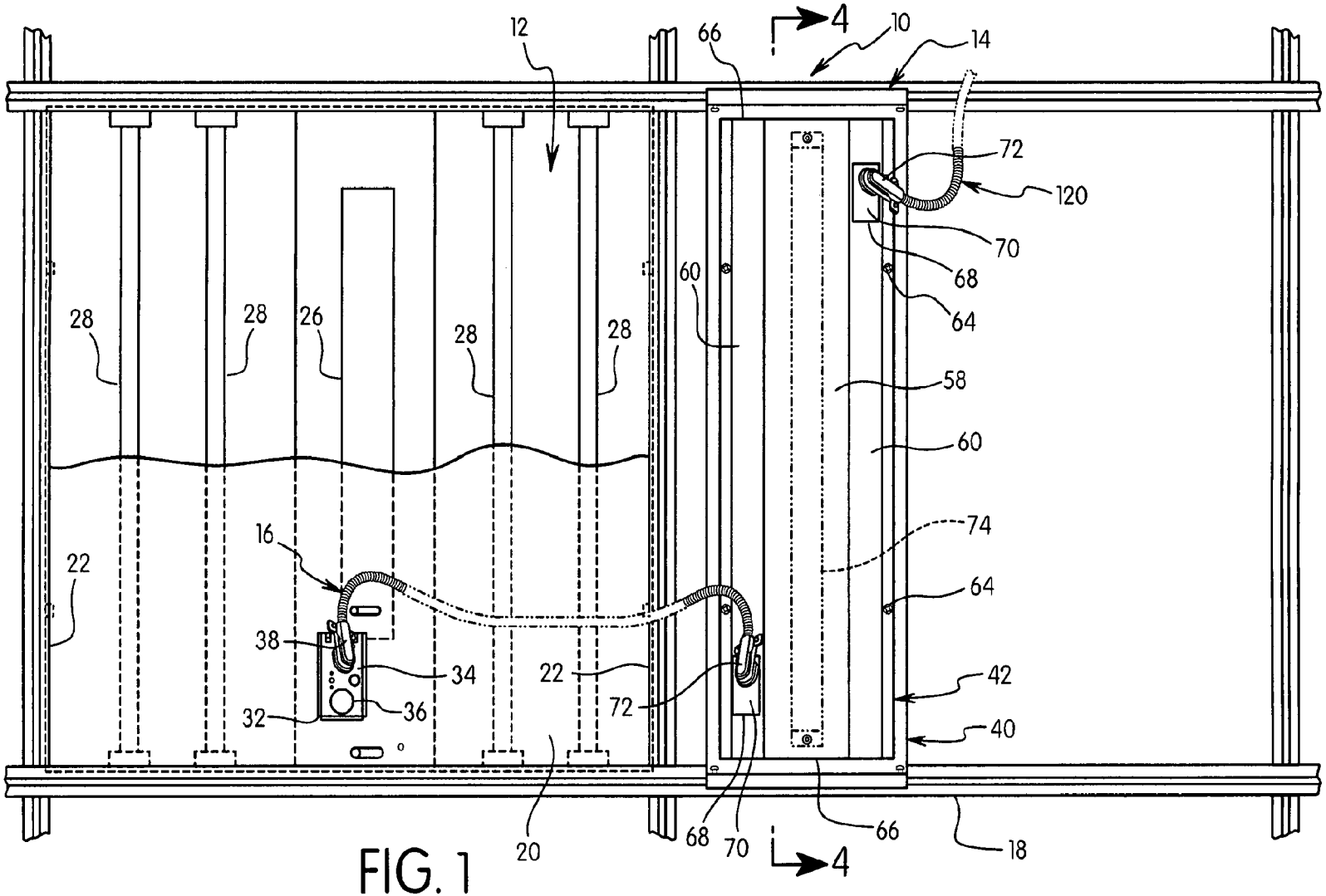
FIG. 1 is a top view of the lighting fixture and ballast assembly mounted to a ceiling grid.

The present invention is directed to a shallow, low profile ballast assembly and to an emergency power system for use in connection with a recessed lighting fixture. The invention is particularly directed to an emergency ballast and power system that can be mounted adjacent a fluorescent lighting fixture where the ballast assembly has a low profile to accommodate for lighting fixtures mounted where there is limited space above the lighting fixture.

Referring to the drawings, the lighting assembly 10 of the invention includes a lighting fixture 12, a ballast housing 14 and a wiring harness 16 extending between lighting fixture 12 and ballast housing 14.

Figure 2:
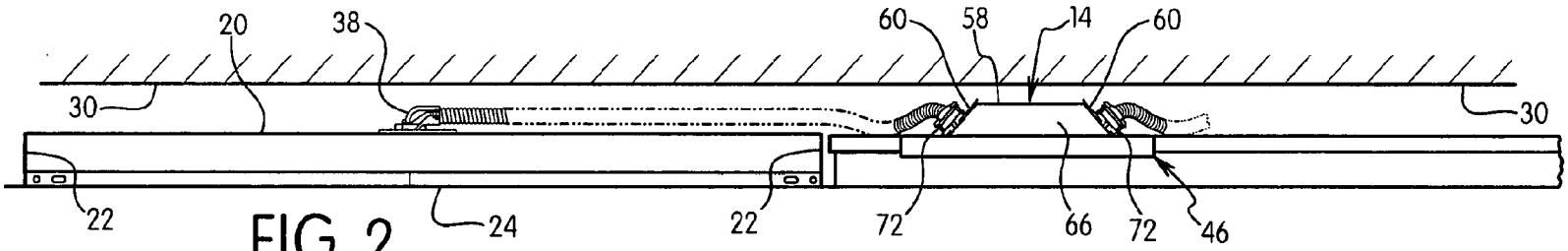
FIG. 2 is a side view of the lighting fixture and ballast assembly of FIG. 1.
Figure 5:
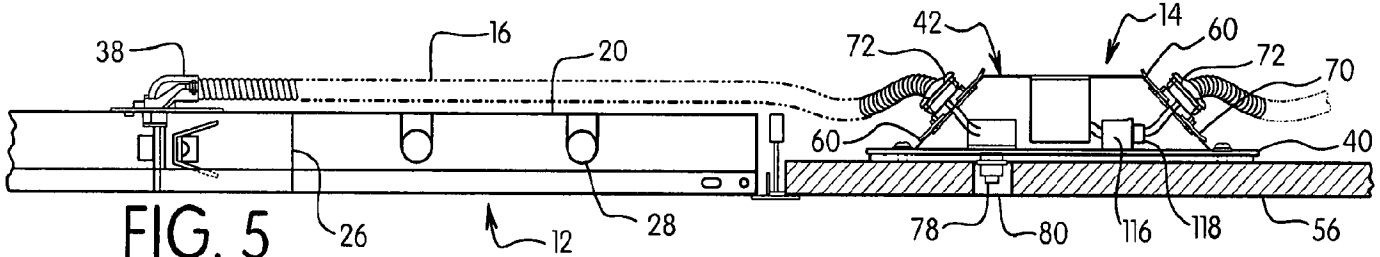
FIG. 5 is a partial cross-sectional end view of the lighting fixture and ballast assembly.

Light fixture 12 in the embodiment illustrated in FIGS. 1 and 2 is a ceiling mounted fixture that is mounted to a standard T-bar ceiling grid 18. Light fixture 12 has a top wall 20, side walls 22 and an open bottom 24. Light fixture 12 encloses a fluorescent light AC ballast 26 and lamps 28 as shown in FIG. 5. The light fixture housing includes a lip or bracket for mounting to the ceiling grid 18. In the embodiment shown, light fixture 12 includes four fluorescent lamps although any number of lamps can be provided.

In the embodiment illustrated, light fixture 12 has a shallow, low profile construction for use in suspended ceilings with limited space above the ceiling grid. As shown in FIG. 2, light fixture 12 is mounted to ceiling grid 18 and is closely spaced to ceiling 30. In this embodiment, access to the top wall 20 of light fixture 12 is not available. In the embodiment illustrated, top wall 20 of light fixture 12 has an opening 32 to allow the electrical connections to be made to light fixture 20 and an adapter plate 34 to cover opening 32 and attached to top wall 20. Adapter plate 34 includes a knock-out or pry-out 36 for coupling with an electrical connector 38.

Figure 3:
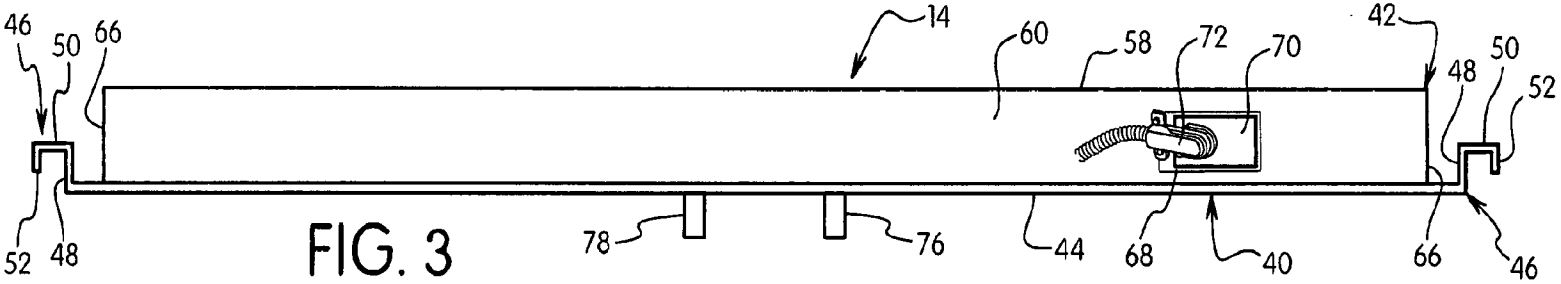
FIG. 3 is a side view of the ballast assembly.
Figure 4:
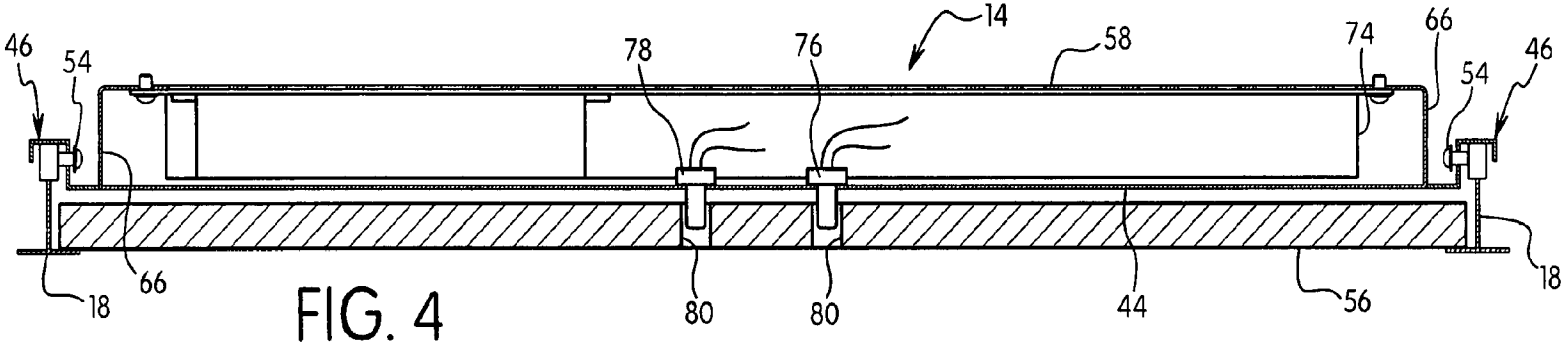
FIG. 4 is a partial cross-sectional view of the ballast assembly taken along line 4-4 of FIG. 1.

Ballast housing 14 is constructed for mounting directly to the ceiling grid 18 adjacent or in close proximity to light fixture 12 as shown in FIG. 1. Ballast housing 14 includes a support platform 40 and a housing 42. Support platform 40 in one embodiment of the invention is a unitary one piece unit having a base defining a bottom wall 44 and a coupling member 46 at each longitudinal end as shown in FIG. 3 and FIG. 4. Bottom wall 44 has a substantially flat planar configuration as shown in FIG. 4 and has a length slightly greater than the longitudinal length of housing 42. Coupling member 46 is defined by an upwardly extending flange 48 and an outwardly extending flange 50 extending substantially parallel to bottom wall 44. Horizontal flange 50 includes a downwardly turned lip 52 for engaging ceiling grid 18 as shown in FIG. 4. A threaded screw 54 extends through an aperture in flange 48 to engage ceiling grid 18 to secure support platform 40 to the ceiling grid. As shown in FIG. 4, bottom wall 44 is positioned below the top edge of ceiling grid 18 and is closely spaced to the ceiling tiles 56 that are supported by the ceiling grid 18. In a preferred embodiment, coupling member 46 is a continuous member on each longitudinal end of support platform 40 and extends the entire width of support platform 40 to provide secure and efficient coupling and mounting to the ceiling grid 18.

Housing 42 of ballast housing 14 provides a low profile configuration to fit within the space above the ceiling grid 18. Housing 42 has a top wall 58 and inclined side walls 60. As shown in FIG. 3, side walls 60 diverge outwardly from top wall 58 to bottom wall 44 to face in a generally upward direction. Side walls 60 include an outwardly extending flange 62 for mating with bottom wall 44 for attachment to bottom wall 44 by screws 64 or other fasteners. Housing 42 includes end walls 66 to close housing 42.

Side walls 60 are angled at an acute angle with respect to bottom wall 44 so that housing 42 has a substantially trapezoid shape. Each side wall 60 has at least one opening 68 for accessing the internal wiring of ballast housing 14. An adapter plate 70 is attached to the respective side wall 60 to cover the opening 68. Electrical connectors 72 are attached to an opening in the adapter plate 70 to provide a power source to ballast housing 14 and to provide electrical connection between ballast housing 14 and light fixture 12. As shown in FIG. 2, the inclined side walls 60 enable the connectors 72 to lie in a plane below the plane of top wall 58 so that wiring harness 16 and the connector 72 do not protrude above the top wall 58, thereby providing a low profile construction and enabling installation in ceilings where there is limited spaced available. The inclined side walls also enable easy access to the side walls and the openings for efficient connection of the wiring harness.

Ballast housing 14 in one embodiment encloses an emergency ballast and battery pack 74 for supplying emergency power to light fixture 12 in the event of a power outage. Ballast housing 14 also encloses a ballast 74 which in one preferred embodiment is an emergency DC ballast and battery pack with suitable circuitry for providing the switching to emergency power and charging the battery when power is restored as shown in the schematic diagram of FIG. 10.

In one embodiment, ballast 74 of ballast housing 14 is a fluorescent AC ballast in addition to or as an alternative to the emergency ballast and battery pack. The fluorescent AC ballast can be connected to one or more fluorescent lights within lighting fixture 12. The remote ballast can be used as a second ballast to operate at least one or all of the fluorescent lamps. In one embodiment, ballast 26 supported by lighting fixture 12 can be connected to one or more, but less than all of the fluorescent lamps 28, and the AC ballast in the remote ballast housing can be connected to the remaining fluorescent lamps. This arrangement is particularly suitable for fluorescent lighting fixtures where the housing is sufficiently small that it is not able to enclose a ballast or a ballast of sufficient size to operate all of the fluorescent lamps. In another embodiment, the remote ballast can operate all of the fluorescent lamps so that the lighting fixture can be constructed without a fluorescent ballast to reduce the size and weight of the lighting fixture. In one embodiment, the ballast housing 14 includes ballast 74 which can be a fluorescent AC ballast to operate the fluorescent lamps 28 when lighting fixture 12 does not include an AC ballast. In this arrangement, remote ballast housing 14 may not include an emergency ballast and power source although one can be provided if desired.

Figure 9:
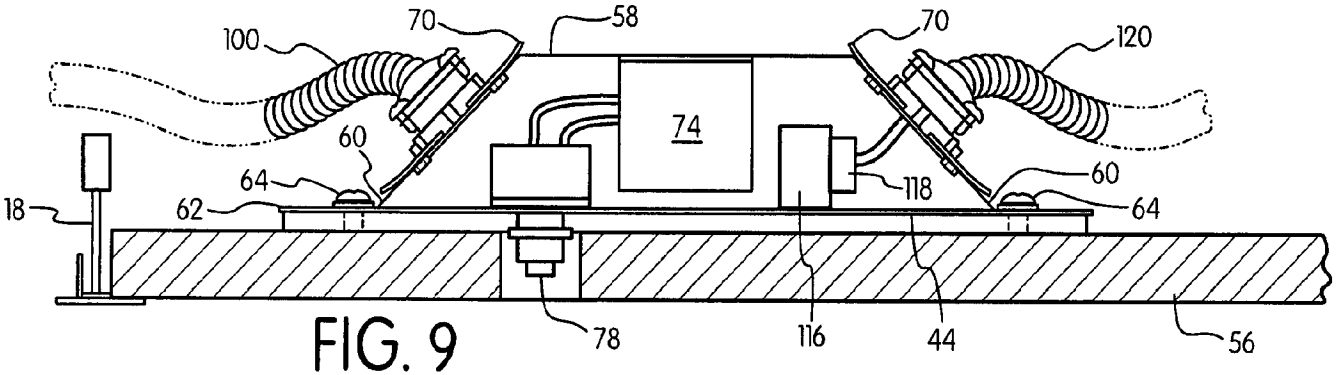
FIG. 9 is an enlarged cross-sectional end view of the ballast assembly.
Figure 10:
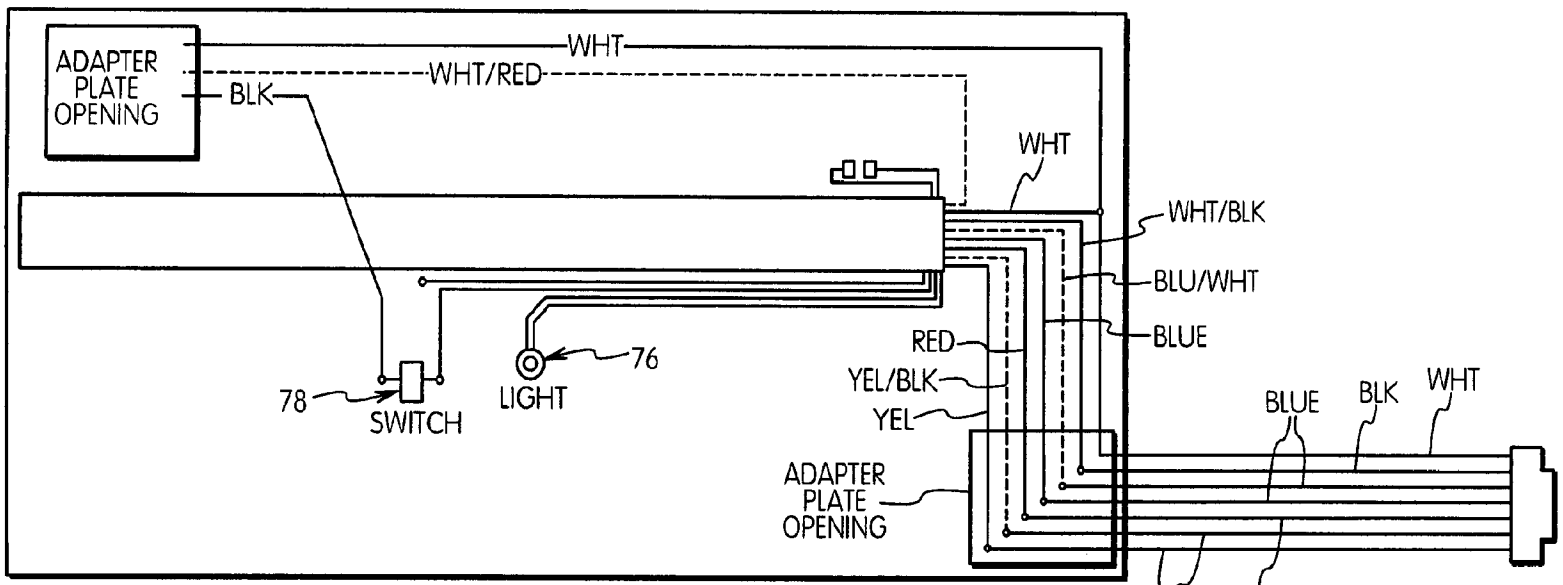
FIG. 10 is a schematic view of the ballast assembly showing the emergency ballast, test switch and test light.

Ballast housing 14 also includes a test light 76 and a test switch 78 that are mounted in bottom wall 44. As shown in FIGS. 4 and 9, test light 76 and test switch 78 extend through an opening in bottom wall 44 and extend downwardly for easy access by the user. Ceiling tiles 56 are provided with access openings 80 aligned with test light 76 and test switch 78 for access and visibility by the user. Test light 76 and test switch 78 are electrically coupled to the circuitry and battery pack of emergency ballast 74 for testing the operation of the emergency ballast as shown in FIG. 10. In the embodiment illustrated, ballast 74 is attached to top wall 58 of housing 42 by screws or other fasteners.

Figure 8:
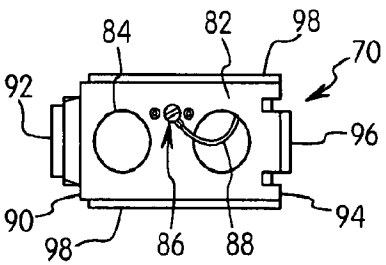
FIG. 8 is a top view of the adapter plate in one embodiment of the invention.
Figure 6:
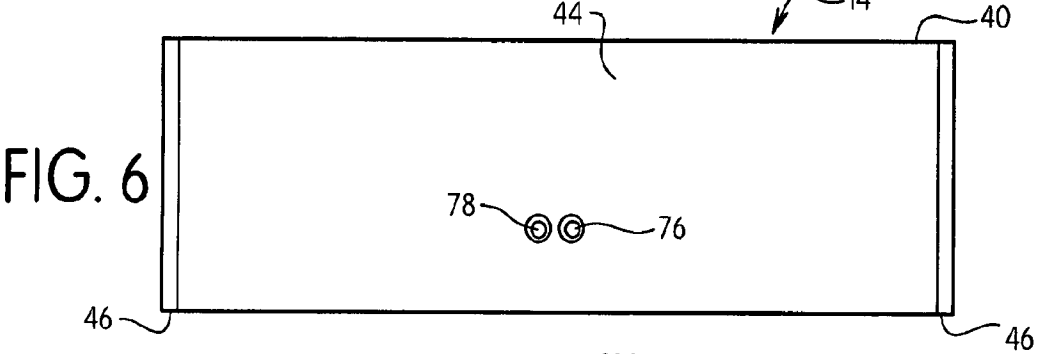
FIG. 6 is a bottom view of the ballast assembly.

Adapter plate 70 as shown in FIG. 8 has a substantially rectangular configuration to cover the respective opening 68 in side walls 60. Adapter plate 70 includes a substantially planar body 82 with at least one opening 84 for receiving the electrical wiring connections. A ground screw 86 is provided on body 82 for coupling to a ground wire 88. A first longitudinal end 90 of body 82 includes a coupling tab 92 for inserting into the respective opening 68. A second longitudinal end 94 includes a tab 96 for engaging a top surface of side wall 60 adjacent the opening 68 for coupling to the side wall 68. Side flanges 98 extend along the side edges of body 82. Side flanges 98 have a substantially L-shape extending upwardly from the plane of body 82 for contacting the outer surface of side wall 60, whereby body 82 is able to lie in a plane with the respective side wall 60.

Figure 7:
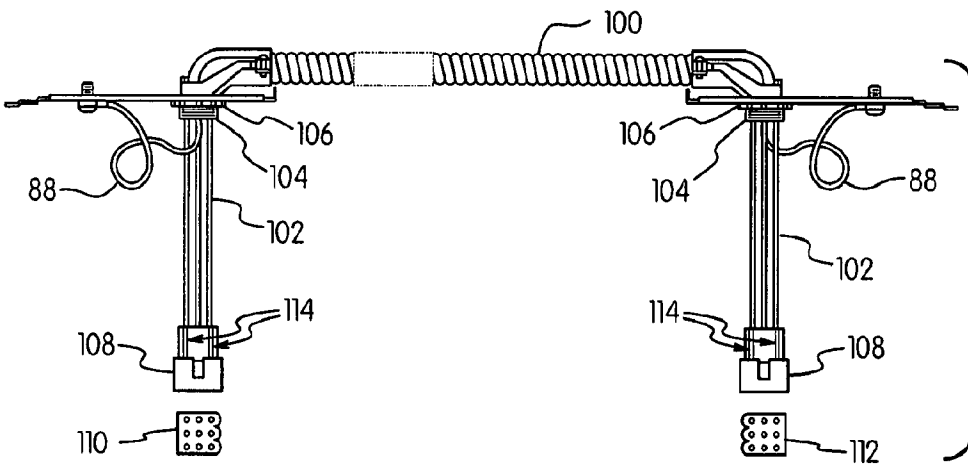
FIG. 7 is a schematic diagram of the wiring harness showing the adapter plates and the plugs for connecting to the lighting fixture and ballast assembly.

Wiring harness 16 as shown in FIG. 7 includes an armor sheathing 100 enclosing electrical wires 102. Electrical connectors 38 have a substantially L-shape to provide a low profile connection so that wiring harness 16 can lie flat against the side walls 60 of ballast housing 14 and the top wall 20 of light fixture 12 as shown in FIG. 5. Electrical connector 38 in the embodiment shown has a threaded end 104 for receiving a locking nut 106 for coupling connector 38 to adapter plate 70. In alternative embodiments, connector 38 can include a snap in push type connector for coupling connector 38 to adapter plate 70.

In a preferred embodiment of the invention, wiring harness 16 includes a plug 108 at each end for mating with a corresponding connector 110 mounted within light fixture 12 and a connector 112 mounted within ballast housing 14 as shown in FIG. 7. Plug 108 and the corresponding connectors include the appropriate number of prongs and corresponding receiving apertures and alignment ribs 114. In the embodiment illustrated, wiring harness 16 can be easily connected to the light fixture 12 and ballast housing 14 by inserting the plug 108 through the opening and coupling the plug with the corresponding connector, and thereafter coupling the adapter plate to the light fixture 12 and the ballast housing 14. The quick connect plugs provide a convenient means for connecting the light fixture 12 and the emergency ballast together in locations where the working space is limited and accessibility to the upper portion of the light fixture and emergency ballast 14 is limited or unavailable. The ballast housing 14 also includes a connector 116 and a corresponding plug 118 for connecting a power supply 120 in substantially the same manner.

The lighting assembly of the invention provides a low profile assembly that can be mounted to a ceiling grid in areas where limited space is available above the ceiling grid. The light fixture 12 and ballast housing 14 are provided with plugs and connectors for quickly and easily connecting the wiring harness and power cable to the light fixture and ballast. The L-shaped connectors 38 and 72 provide a low profile assembly such that the wiring harness and the cables can lie flat against the top surface of the light fixture 12 without protruding upwardly. The inclined side walls of ballast housing 14 enable a low profile assembly while allowing access to the internal components of the ballast housing 14, and particularly for connecting the wiring harness and power cable to the corresponding connectors within the ballast housing 14. As shown in FIG. 3, bottom wall 44 of support platform 40 is recessed with respect to the top edge of the ceiling grid, whereby the ballast housing 14 is recessed with respect to the emergency grid thereby providing a low profile and reducing the height of the ballast housing within the ceiling space. In one embodiment of the invention, the combined height of the light fixture 12 and wiring harness 16 is equal to or less than the height of the ballast housing 14 defined by the top wall of the emergency ballast. As shown in FIG. 2, the connectors, wiring harness and electrical supply cables do not extend above the top wall of ballast housing 14 and lie within a space defined between the bottom and top of the ballast housing 14.

While various embodiments have been chosen to illustrate the invention, it will be understood by those skilled in the art that various changes and modifications can be made without departing from the scope of the invention as defined in the appended claims.

What is claimed is:

1. A remote ballast and lighting assembly comprising:

a lighting fixture having a housing adapted for mounting in association with a ceiling grid;

a ballast housing remote from said lighting fixture housing and enclosing a ballast and having a top wall, a support platform, and first and second side walls inclined with respect to said support platform, at least one of said side walls having an electrical connection; and an electrical cable extending between said ballast housing and said top wall of said lighting fixture housing, said ballast housing being mounted on said ceiling grid adjacent said lighting fixture housing, and said lighting fixture housing and cable having a combined height equal to or less than a height of said ballast housing with respect to the ceiling grid.

2. The assembly of claim 1, wherein said lighting fixture housing includes a top wall, side walls extending from said top wall, and an open bottom, said housing enclosing a ballast and at least one lamp connected to said ballast, said top wall having an opening for receiving said electrical cable and where said ballast housing encloses an emergency ballast having an emergency power source.

3. The assembly of claim 2, wherein said opening in said top wall includes an adapter plate coupled to said housing and where said adapter plate includes a coupling for coupling with said electrical cable.

4. The assembly of claim 3, wherein at least one of said inclined side walls having an opening and an adapter plate covering said opening and coupled to said housing, said adapter plate having a coupling member for coupling with the electrical cable to electrically connect the ballast to the lighting fixture.

5. The assembly of claim 1, wherein said support platform as a first longitudinal end having an upwardly extending flange with a top end and a coupling lip extending from said top end, and a second longitudinal end having an upwardly extending flange with a top end and a coupling lip extending from said top end, said coupling lips engaging the ceiling grid to support said ballast housing, and where said support platform is positioned below a top edge of the ceiling grid.

6. The assembly of claim 5, wherein said ballast housing having a test light or test switch on said support platform and being accessible below said ballast housing.

7. The assembly of claim 6, further comprising a ceiling tile below said ballast housing, said ceiling tile having an access opening for accessing said test light or test switch.

8. A remote ballast and lighting assembly comprising:

a lighting fixture mounted to a ceiling grid, said lighting fixture having a housing with a top wall, an open bottom and first and second side walls, a first ballast and at least one lamp contained within said housing;

a ballast housing having a support platform defining a bottom wall, a top wall and first and second side walls that are inclined with respect to said support platform, said ballast housing enclosing an emergency ballast and a rechargeable power source, the support platform having a first longitudinal end with a first coupling lip and a second longitudinal end with a second coupling lip, said first and second coupling lips being coupled to the ceiling grid to mount the ballast housing adjacent the lighting fixture on the ceiling grid; and a wiring harness extending between said top wall of said lighting fixture and one of said inclined side walls of said ballast housing, said lighting fixture and said wiring harness having a combined height equal to or less than a height of said ballast housing.

9. The assembly of claim 8, wherein said top wall of said lighting fixture housing includes an opening and an adapter plate covering said opening and coupled to said top wall, and an L-shaped connector member on said adapter plate for coupling with said wiring harness to electrically couple to said lighting fixture, and where said ballast housing encloses a second fluorescent ballast connected to at least one fluorescent lamp in said lighting fixture.

10. The assembly of claim 8, wherein said first side wall of said ballast housing having an opening and an adapter plate coupled to said ballast housing and covering said opening, and an L-shaped connector member on said adapter plate for coupling with said wiring harness, said second side wall of said ballast housing having an opening and an adapter plate coupled to said ballast housing and covering said opening, and an L-shaped connector member on said adapter plate for coupling to a power cable, wherein said wiring harness and said power cable lie below a plane of said top wall of said ballast housing.

11. The assembly of claim 8, wherein said first longitudinal end of said support platform has a first upwardly extending flange and said first coupling lip extending from a top end of said flange, said second longitudinal end of said support platform has a second upwardly extending flange and said second coupling lip extending from a top end of said flange, and wherein said support platform lies in a plane below a top end of said ceiling grid.

12. The assembly of claim 11, wherein said support platform of said ballast housing includes a test light or test switch operatively coupled to said emergency ballast and rechargeable power source, said test light or test switch being accessible from below said ballast housing, and said ceiling grid including a ceiling tile below said ballast housing, said ceiling tile having an aperture for accessing said test light or test switch.

13. The assembly of claim 8, wherein said ballast housing extends above a top end of said ceiling grid a distance less than a height of said ballast housing and where said ballast housing is recessed with respect to the top end of the ceiling grid.

14. The assembly of claim 12, wherein said wiring harness lies in a plane below a plane of said top wall of said ballast housing.

15. An emergency ballast and lighting assembly, comprising:

a lighting fixture mounted to a ceiling grid, said lighting fixture having a housing with a top wall, an open bottom and side walls extending between said top wall and said open bottom, said lighting housing enclosing at least one lamp and a ballast;

a ballast housing having a support platform defining a bottom wall, a top wall and first and second inclined side walls extending between said bottom wall and top wall, the ballast housing enclosing an emergency ballast and an emergency rechargeable power source, the support platform having a first longitudinal end with a first coupling lip and a second longitudinal end having a second coupling lip, said first and second coupling lips being coupled to said ceiling grid to mount the ballast housing adjacent the lighting fixture, said support platform lying in a plane below a top edge of the ceiling grid; and a wiring harness extending between the top wall of the lighting fixture and one of said side walls of said ballast housing, said wiring harness lying in a plane at or below a plane of said top wall of said ballast housing, said ballast housing and said lighting fixture including an electrical receptacle and said wiring harness including a plug for mating with a respective plug for electrically connecting said lighting fixture to said ballast housing.

16. The assembly of claim 15, wherein said top wall of said lighting fixture housing includes an opening and an adapter plate covering said opening and coupled to said housing, and an L-shaped connector member extending from said adapter plate and being coupled to said wiring harness whereby said wiring harness lies below a plane of said top wall of said ballast housing.

17. The assembly of claim 15, wherein said first side wall of said ballast housing has an opening with an adapter plate covering said opening and coupled to said side wall, and an L-shaped connector member extending from said adapter plate and first side wall and coupled to said wiring harness whereby said wiring harness lies below a plane of said top wall of said ballast housing.

18. The assembly of claim 17, wherein said second side wall of said ballast housing has an opening with an adapter plate covering said opening and coupled to said side wall, and an L-shaped connector member extending from said adapter plate and second side wall and coupled to a power cable whereby said power cable lies in a plane below a plane of said top wall of said ballast housing.

19. The assembly of claim 15, wherein said first longitudinal end of said support platform of said ballast housing has a first upwardly extending flange with said first coupling lip extending from a top end of said first flange, said second longitudinal end of said support platform has a second upwardly extending flange with said second coupling lip extending from a top end of said second flange, and wherein said support platform lies in a plane below a top end of the ceiling grid with said top wall of said ballast housing lying in a plane at or below a plane of said wiring harness on the top wall of said lighting fixture.

20. The assembly of claim 19, further comprising a test light or test switch on a bottom face of said support platform and operatively connected to said emergency ballast and rechargeable power source, said test light or test switch being accessible from below said ballast housing, and a ceiling tile suspended by said ceiling grid and having an aperture for accessing said test light or test switch.

21. The assembly of claim 20, wherein said ballast housing extends above a top end of said ceiling grid a distance less than a height of said ballast housing and where said ballast housing is recessed with respect to said ceiling grid.

22. The assembly of claim 15, wherein said ballast housing encloses a fluorescent ballast operatively connected to at least one fluorescent lamp on said lighting fixture.

23. A remote ballast and lighting assembly comprising:

a lighting fixture housing adapted for mounting on a ceiling grid, said lighting fixture housing including a light source;

a ballast housing enclosing a ballast and having a top wall, a bottom wall, and first and second side walls, at least one of said side walls having an electrical connection, said ballast housing adapted for mounting to a ceiling grid remote from said lighting fixture housing; and an electrical cable extending between said ballast housing and said lighting fixture housing, said ballast housing being mountable on said ceiling grid adjacent said lighting fixture housing, and said lighting fixture housing and cable having a combined height with respect to the ceiling grid equal to or less than a height of said ballast housing.

24. The assembly of claim 23, wherein said lighting fixture housing comprises a light source and a primary ballast.

25. The assembly of claim 24, wherein said ballast housing further comprises an emergency power supply.

26. The assembly of claim 25, wherein said emergency power supply is rechargeable.

27. The assembly of claim 23, wherein said lighting fixture housing includes an opening for receiving an adapter plate having a coupling for coupling to said electrical cable.

28. The assembly of claim 23, wherein said ballast housing has a coupling member at a first end and a coupling member at a second end for mating with the ceiling grid.

29. The assembly of claim 28, wherein said coupling members position said bottom wall below a top edge of the ceiling grid.

30. The assembly of claim 23, wherein said electrical cable is coupled to a side wall of said ballast housing and coupled to a top wall of said lighting fixture housing.

* * * * *